US010746063B2

(12) United States Patent
Stucchi et al.

(10) Patent No.: US 10,746,063 B2
(45) Date of Patent: Aug. 18, 2020

(54) SYSTEM AND METHOD FOR ACTUATING AN ENGINE VALVE OF AN INTERNAL COMBUSTION ENGINE

(71) Applicant: C.R.F. Società Consortile per Azioni, Orbassano (IT)

(72) Inventors: Sergio Stucchi, Valenzano (IT); Marcello Gargano, Torre a Mare (IT); Raffaele Ricco, Casamassima (IT); Onofrio De Michele, Castellana Grotte (IT)

(73) Assignee: C.R.F. Societàà Consortile per Azioni, Orbassano (Turin) (IT)

( * ) Notice: Subject to any disclaimer, the term of this patent is extended or adjusted under 35 U.S.C. 154(b) by 0 days.

(21) Appl. No.: 16/110,517

(22) Filed: Aug. 23, 2018

(65) Prior Publication Data

US 2019/0162085 A1 May 30, 2019

(30) Foreign Application Priority Data

Nov. 27, 2017 (EP) ..... 17203737

(51) Int. Cl.
*F01L 9/02* (2006.01)
*F01L 1/46* (2006.01)
(Continued)

(52) U.S. Cl.
CPC ..... *F01L 9/023* (2013.01); *F01L 1/14* (2013.01); *F01L 1/245* (2013.01); *F01L 1/462* (2013.01);
(Continued)

(58) Field of Classification Search
CPC ... F01L 13/0005; F01L 1/46; F01L 2820/031; F01L 1/245; F01L 1/462;
(Continued)

(56) References Cited

U.S. PATENT DOCUMENTS 5,730,091 A 3/1998 Diehl et al.
6,302,069 B1 * 10/2001 Moyer ..... F01L 1/08 123/90.11
(Continued)

FOREIGN PATENT DOCUMENTS

DE 102008027886 A1 * 12/2009 ..... F01L 3/10
EP 0803642 A1 10/1997
(Continued)

OTHER PUBLICATIONS

Search Report for European Application No. 17203737.6 completed on May 29, 2018.

*Primary Examiner* — Patrick Hamo
*Assistant Examiner* — Wesley G Harris
(74) *Attorney, Agent, or Firm* — Heslin Rothenberg Farley & Mesiti P.C.; Victor A. Cardona, Esq.

(57) ABSTRACT

An actuating system of an engine valve comprises a movable member, for example, in the form of a master piston controlled by a cam of a camshaft. A slave piston is hydraulically controlled by the master piston by means of a volume of pressurized fluid, to open said engine valve against the action of a return spring. The system also comprises an auxiliary device for applying an additional force to the engine valve to keep the engine valve in a closed position. The auxiliary device is configured or controlled in such a way that the total force tending to keep the engine valve in its closed position varies during each rotation cycle of the cam. The total force is higher at least in one part of the rotation cycle of the cam wherein the engine valve must remain in its closed position, and is, instead, reduced at least in one part of the rotation cycle of the cam wherein the engine valve is not in its closed position.

9 Claims, 12 Drawing Sheets

Figure 1:
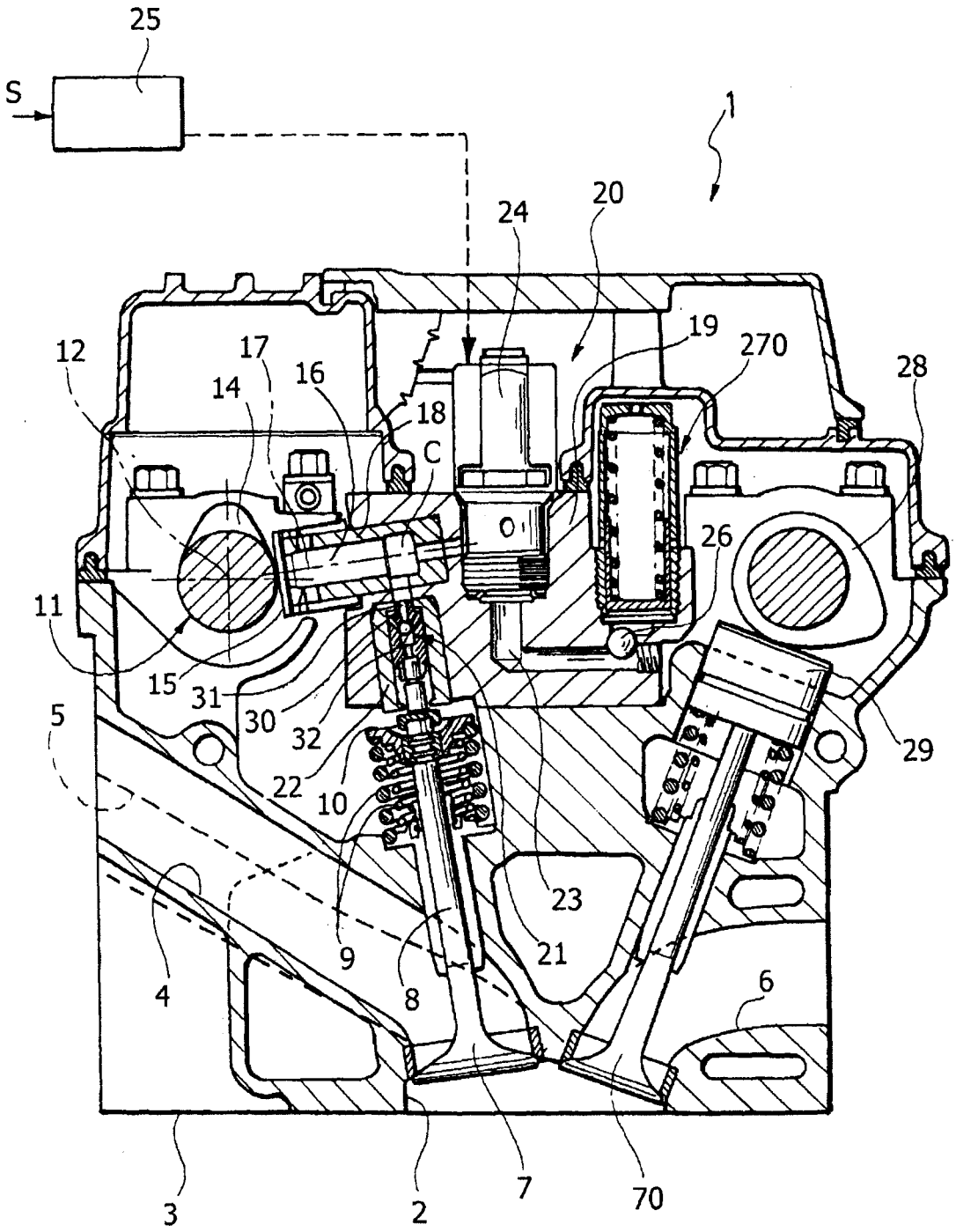

(51) Int. Cl.

| | |
|---|---|
| ***F01L 3/10*** | (2006.01) |
| ***F01L 1/245*** | (2006.01) |
| ***F01L 1/14*** | (2006.01) |
| ***F01L 13/00*** | (2006.01) |
| ***F02D 13/02*** | (2006.01) |

(52) U.S. Cl.
CPC ..... *F01L 3/10* (2013.01); *F01L 9/02* (2013.01); *F01L 13/0005* (2013.01); *F02D 13/0226* (2013.01); *F01L 2201/00* (2013.01)

(58) Field of Classification Search
CPC ..... F01L 2013/001; F01L 2013/0094; F01L 3/24; F01L 9/023; F01L 9/02; F01L 3/10; F01L 1/14; F01L 2201/00; F02D 13/0226
USPC ..... 123/198 F, 90.15, 90.16, 90.12, 90.55
See application file for complete search history.

(56) References Cited

U.S. PATENT DOCUMENTS

| | | | |
|---|---|---|---|
| 6,745,738 | B1 | 6/2004 | Bosscher |
| 2010/0101517 | A1 | 4/2010 | Elendt et al. |

FOREIGN PATENT DOCUMENTS

| | | | | |
|---|---|---|---|---|
| EP | 1091097 | A1 | 4/2001 | |
| EP | 1243761 | A1 | 9/2002 | |
| EP | 1344900 | A2 | 9/2003 | |
| EP | 1555398 | A1 | 7/2005 | |
| EP | 1635045 | A1 | 3/2006 | |
| EP | 1674673 | A1 | 6/2006 | |
| EP | 1726790 | A1 | 11/2006 | |
| EP | 3126643 | | 2/2017 | |
| WO | WO-2008116704 | A1 * | 10/2008 | ..... F01L 1/185 |

* cited by examiner

Prior art

Prior art

Prior art

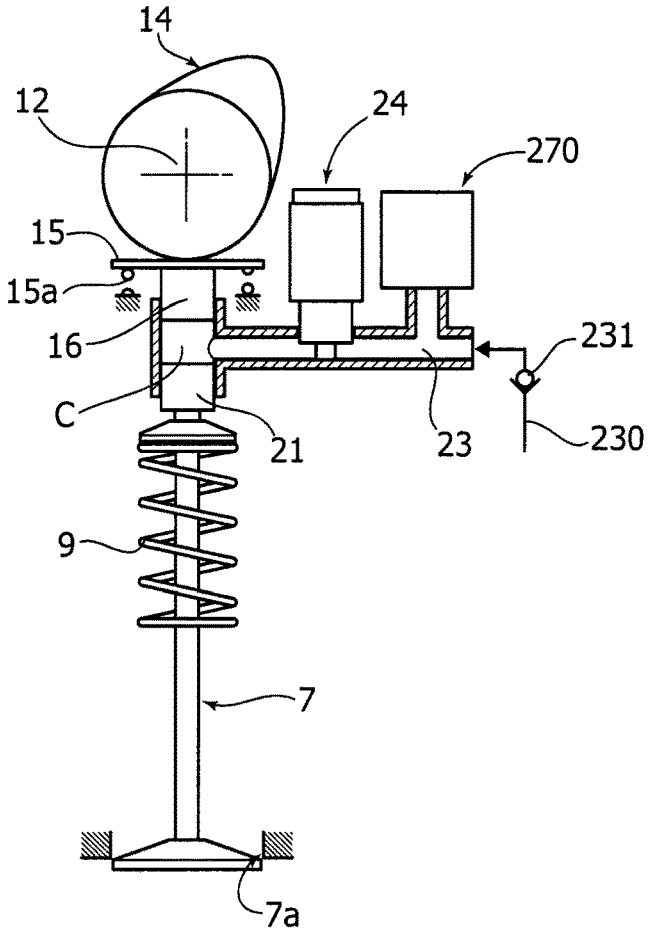
FIG. 4
FIG. 5
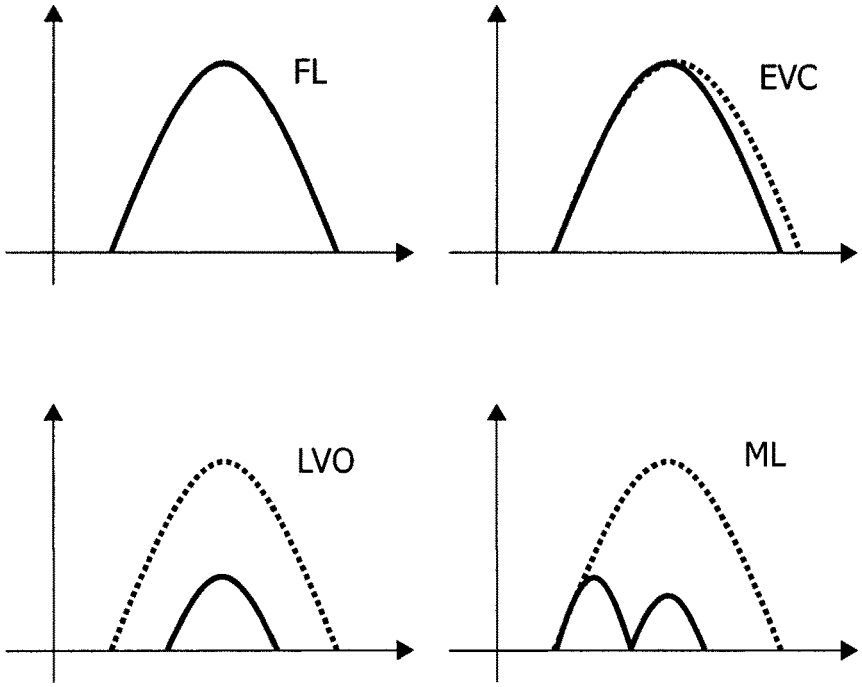

SYSTEM AND METHOD FOR ACTUATING AN ENGINE VALVE OF AN INTERNAL COMBUSTION ENGINE

CROSS REFERENCE TO RELATED APPLICATIONS

This application is claims priority to European Patent Application No. 17 203 737.6 filed on Nov. 27, 2018, the entire disclosure of which is incorporated herein by reference.

FIELD OF THE INVENTION AND PRIOR ART

The present invention relates to a system and a method for actuating an engine valve of an internal combustion engine.

The invention relates, in particular, to a known type of actuating system comprising a movable member directly or indirectly controlled by a cam of a camshaft of the internal combustion engine, and mechanically or hydraulically connected to the engine valve, and at least one return spring biassing the engine valve to the closed position.

A particularly advantageous application of the invention is directed to hydraulic actuating systems, of the type comprising a master piston directly or indirectly controlled by the cam of the camshaft of the internal combustion engine, and a slave piston that drives the engine valve and that is hydraulically controlled by the master piston, by means of a volume of pressurized fluid interposed between the master piston and the slave piston.

However, application of the invention is not excluded to mechanical actuating systems wherein the aforesaid movable member controlled by the cam is a tappet connected directly or indirectly to the engine valve.

A preferred embodiment of the invention is directed to variable hydraulic actuating systems of engine valves, of the type that also includes:

- an electrically-actuated control valve, which controls the communication between said volume of pressurized fluid and an environment at a lower pressure connected to a fluid accumulator, in such a way that:

- when the electrically-actuated control valve keeps said communication closed, the engine valve can be actuated by said cam, while
- when the electrically-actuated control valve keeps said communication open, fluid can discharge from the volume of pressurized fluid into the aforesaid lower pressure environment, so that the engine valve remains insensitive to the movement of said cam, and
- an electronic control unit to control said electrically-actuated control valve,
- said electronic control unit being programmed to control said electrically-actuated valve in such a way as to actuate the engine valve according to one or more different valve modes, depending on the operating conditions of the engine.

For a long time, the Applicant has developed internal combustion engines equipped with a variable actuating system of the engine valves of the type indicated above (see, for example, EP 1 674 673 B1).

It should be noted, however, that the present invention is of general application and can also be directed to mechanical or hydraulic actuating systems of an engine valve that do not provide variable actuation of the engine valve.

Furthermore, although the exemplary embodiments illustrated herein all relate to the actuation of intake valves of the engine, the invention is likewise applicable to the control of exhaust valves.

TECHNICAL PROBLEM

In all known systems involving hydraulic actuation of an engine valve, the transmission of the cam movement to the engine valve may not be immediate, and can result in a loss of movement due to the need to overcome the action of the spring or springs that push the engine valve to its closed position. The return spring must be designed and arranged to exert a relatively high force or, in any case, a force sufficient to ensure that the engine valve remains closed during the part of the rotation cycle of the cam in which the engine valve must remain closed, whatever the operating conditions of the engine are, as well as the running conditions of the vehicle using said engine. Therefore, it is not possible to facilitate the opening stage of the engine valve by adopting a reduced stiffness and/or a reduced load of the return spring or springs below a certain limit.

Therefore, in hydraulic actuating systems, a relatively high pressure level in the volume of fluid that transmits movement from the cam to the engine valve is required, resulting in greater energy consumption. In addition, the risk of a loss of movement in the transmission between the cam and the engine valve is particularly damaging in a variable actuating system, which must respond accurately and promptly to varying engine operating conditions (for example, rotational speed and load of the engine) by correspondingly varying the lift and the opening and closing times of the engine valves.

In more conventional actuating systems with a cam-driven tappet that mechanically drives the engine valve, there is still the problem of attenuating vibrations and noise due to the high load of the return spring or springs of the engine valve.

OBJECT OF THE INVENTION

The object of the present invention is to overcome the problem discussed above by providing an actuating system for an engine valve that, on the one hand, reduces the energy consumption of the system and, on the other hand, still ensures a precise and immediate response of the engine valve at the command provided by the actuating cam.

SUMMARY OF THE INVENTION

In view of achieving the aforesaid object, the invention relates to an actuating system of an engine valve of an internal combustion engine having the characteristics that have been indicated at the beginning of the present description, and also characterized in that it comprises an auxiliary device for applying an additional force to the engine valve, tending to keep the engine valve in a closed position, said auxiliary device being configured or controlled in such a way that the total force tending to keep the engine valve in its closed position varies during each rotation cycle of the actuating cam of the engine valve, said total force being higher at least in a part of the rotation cycle of the cam in which the engine valve must remain in its closed position and being, however, reduced at least in a part of the rotation cycle of the cam in which the engine valve is not in its closed position.

In the present invention, however, on one hand, it is ensured that in the step in which the engine valve must remain closed, it remains effectively closed, at every operating condition of the engine and in every driving condition of the motor-vehicle using said engine and, on the other hand, it reduces the effort required to cause the opening of the engine valve, at least in a part of the opening step. Thanks to this arrangement, it is therefore possible to provide reliable and accurate operation of the actuating system, without the need to establish a very high pressure level in the volume of high pressure of the system.

In one embodiment, said auxiliary device comprises a solenoid carried by the engine structure and a ferromagnetic anchor associated with the engine valve, and configured to cooperate with the solenoid to tend to keep the engine valve in its closed position when the solenoid is energized. The aforesaid auxiliary device also comprises a control circuit of the solenoid configured to supply current to the solenoid, at least in a part of the rotation cycle of the cam in which the engine valve must remain in its closed position, and not to supply current to the solenoid, instead, at least in one part of the rotation cycle of the cam in which the engine valve is not in its closed position.

In a second embodiment, the auxiliary device comprises an auxiliary elastic element carried by a supporting structure that is fixed with respect to said engine valve during the movement of the engine valve, and configured to cooperate with an engagement element associated with said engine valve in such a way that in a first step of opening the engine valve, a cam surface of said engagement element associated with the engine valve deforms said auxiliary elastic element, generating an additional force tending to close the engine valve, while in a second step of the opening of the engine valve, said auxiliary elastic element is in sliding engagement against a cylindrical surface of said engagement element, so that said auxiliary elastic element remains in a deformed condition, but substantially no longer exerts any additional return force of the engine valve towards its closed position.

In a third embodiment, the auxiliary device comprises a hydraulic cylinder including two cylinder elements slidably mounted with each other, and defining a cylinder chamber between them, and a spring tending to keep said cylinder elements in a position corresponding to a maximum elongation configuration of said cylinder chamber. The aforesaid hydraulic cylinder is operatively interposed between said engine valve and the engine structure, and is configured to have a first operative condition in which the chamber of said hydraulic cylinder is isolated, so that said hydraulic cylinder constitutes an uncompressible member that blocks the engine valve in its closed position, and a second operative condition, in which the chamber of said hydraulic cylinder communicates with a discharge environment, so that said hydraulic cylinder does not prevent opening of the engine valve.

Preferably, the invention is applied to a hydraulic actuating system, comprising a master piston directly or indirectly controlled by the cam of the camshaft of the internal combustion engine, and a slave piston that drives the engine valve and that is hydraulically controlled by the master piston, by means of a volume of pressurized fluid interposed between the master piston and the slave piston.

In the particular case of application of the invention to a variable hydraulic actuating system of the engine valve of the type mentioned above, the system can be configured in such a way that the force tending to keep the engine valve in its closed condition is greater in any condition in which the engine valve must remain closed, that is, both in the part of the actuating chamber rotation cycle, in which the cam does not cause movement of the master piston, and also in all conditions in which the variable actuating system excludes the coupling between the cam and engine valve by discharging the volume of pressurized fluid.

DETAILED DESCRIPTION OF THE EMBODIMENTS

Figure 2:
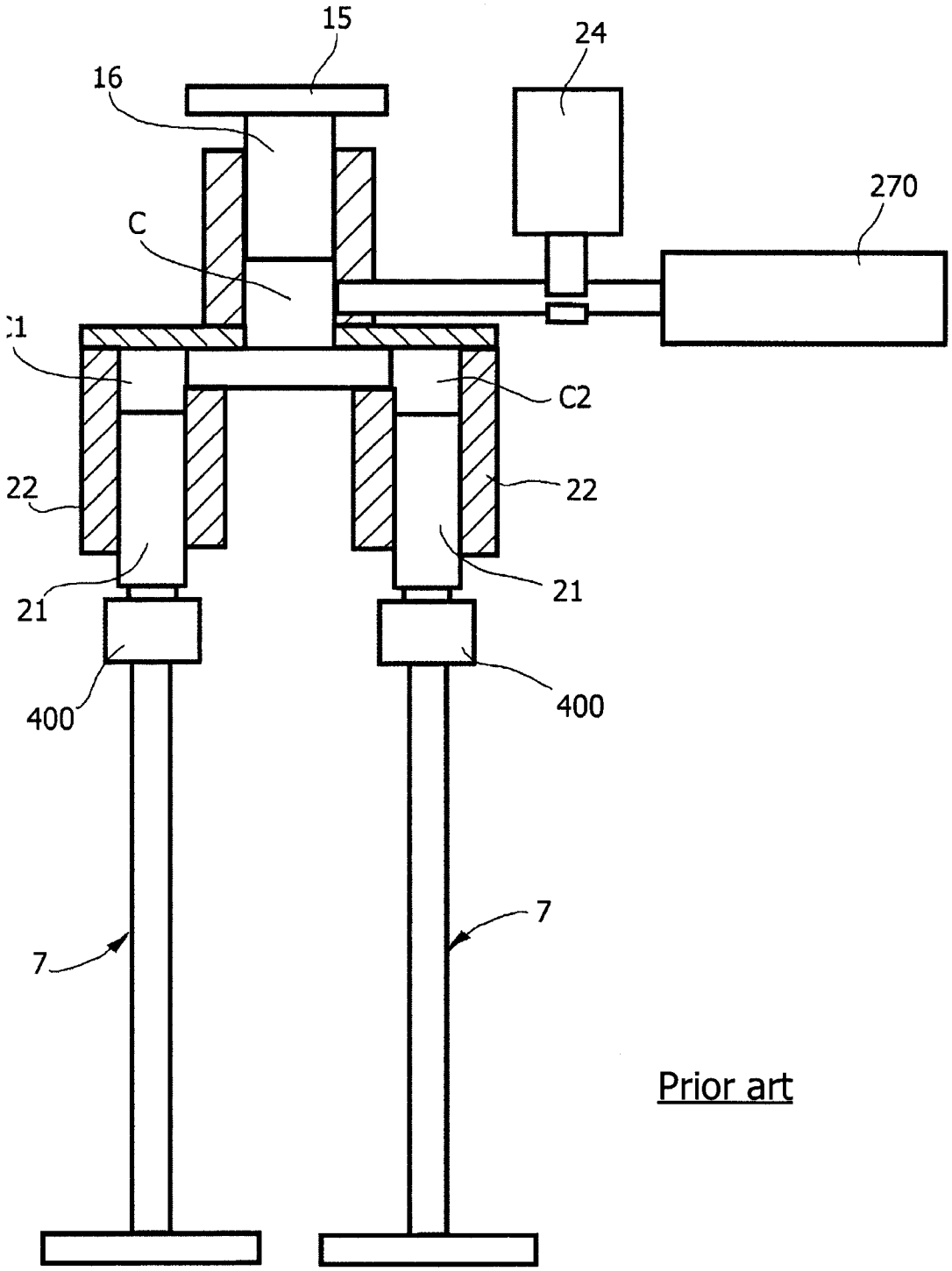
Figure 3:
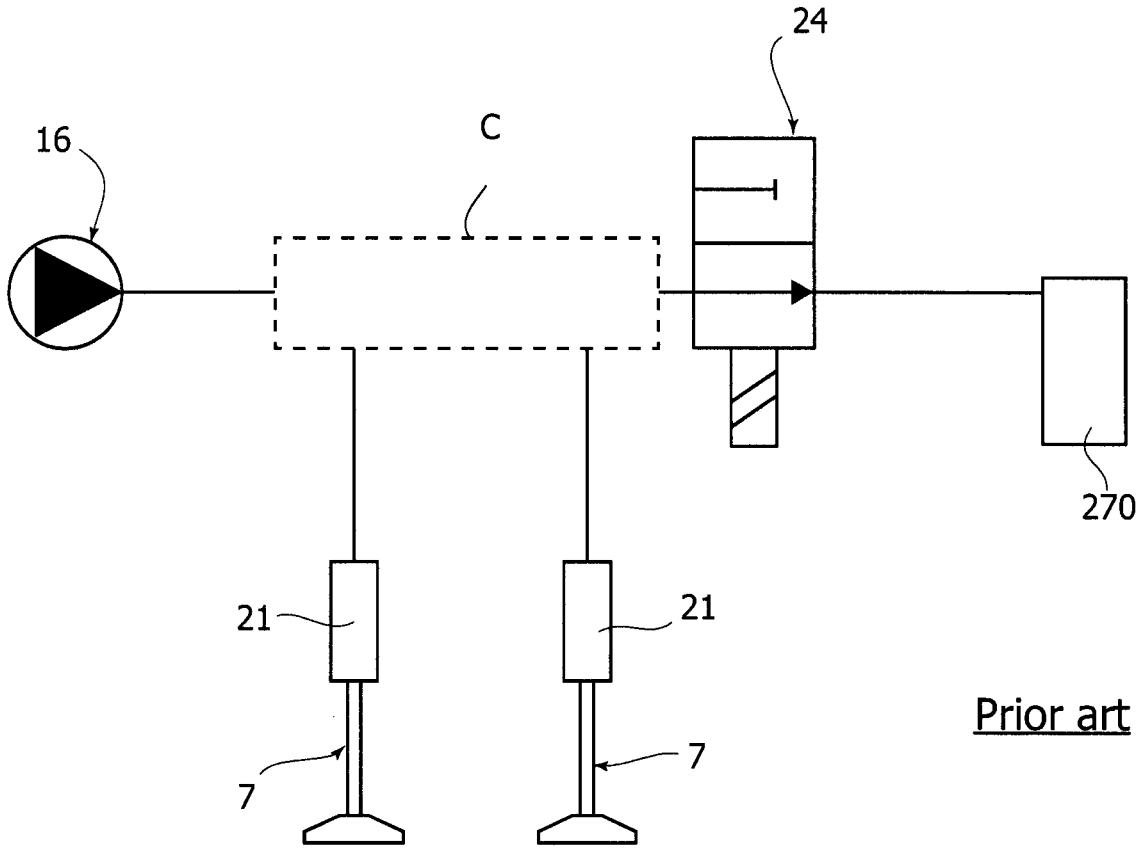
Figure 3A:
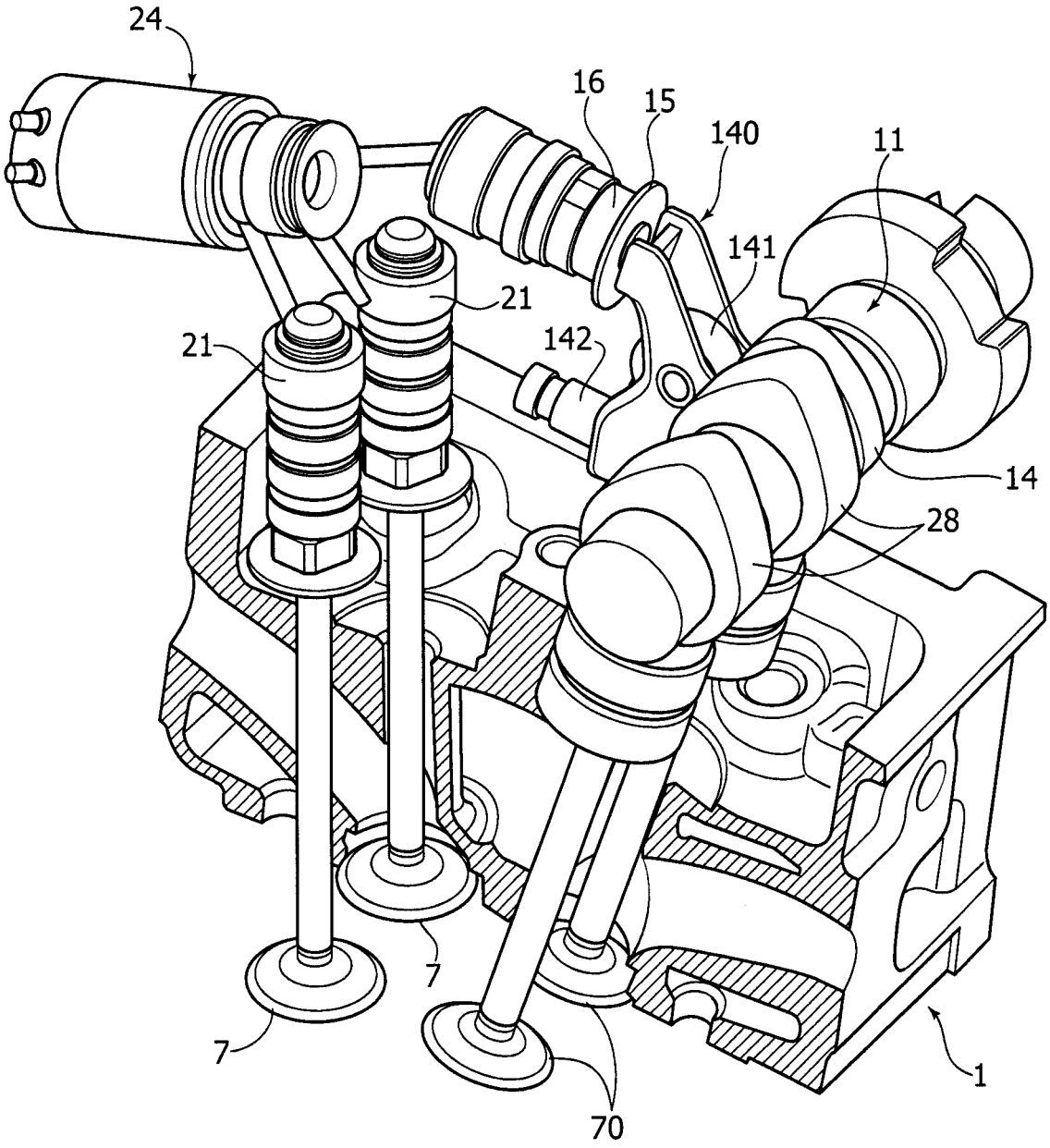
Figure 6:
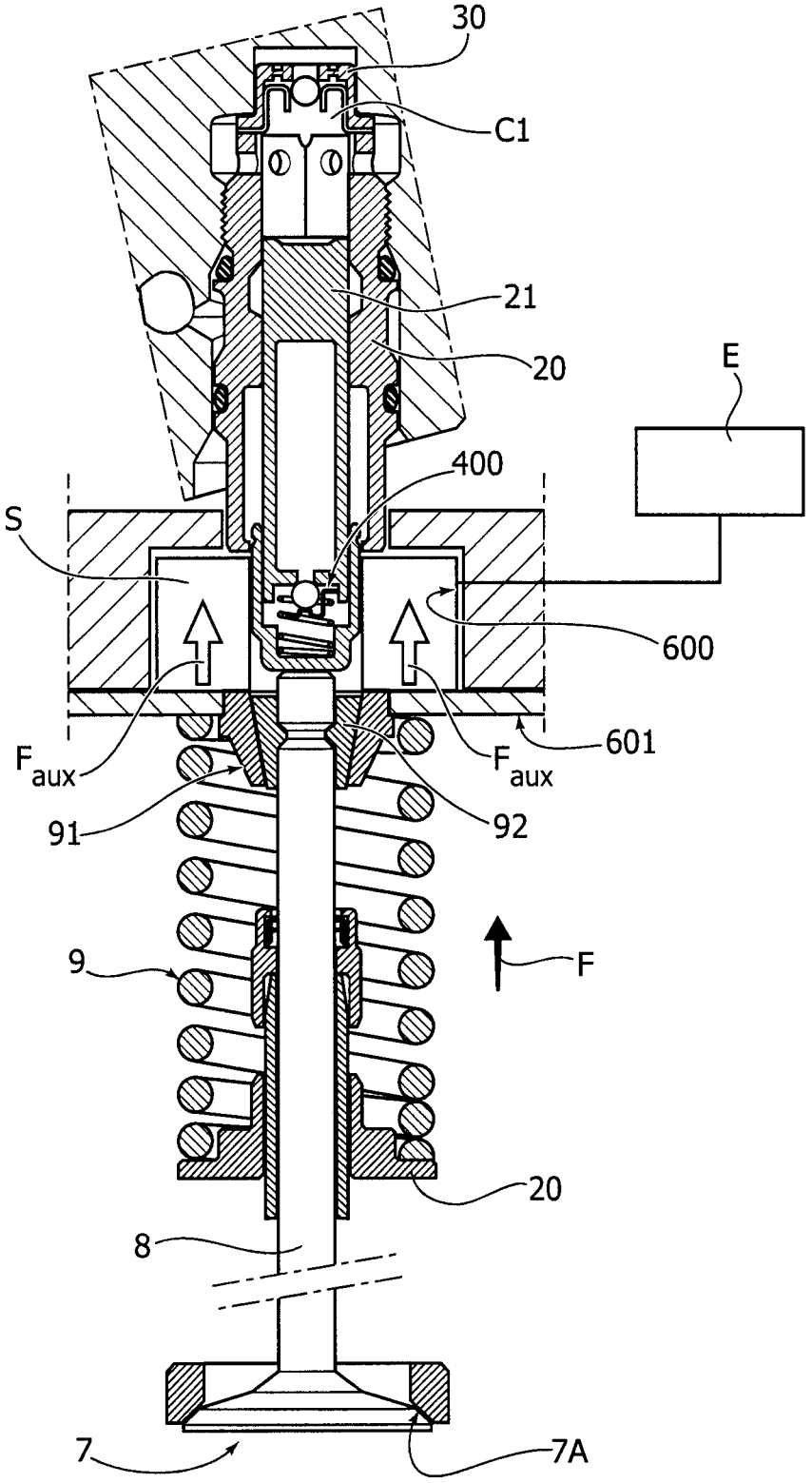
Figure 7:
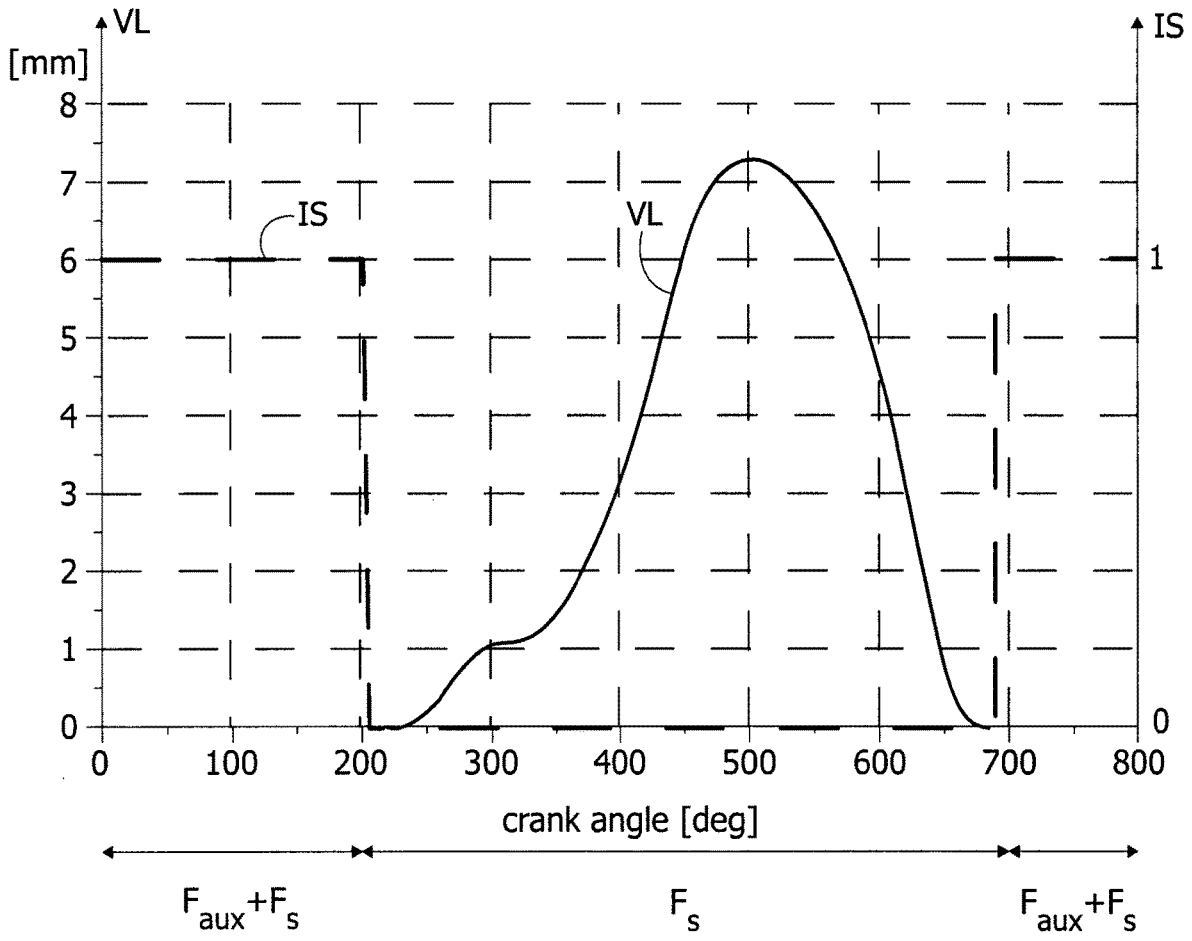
Figure 8:
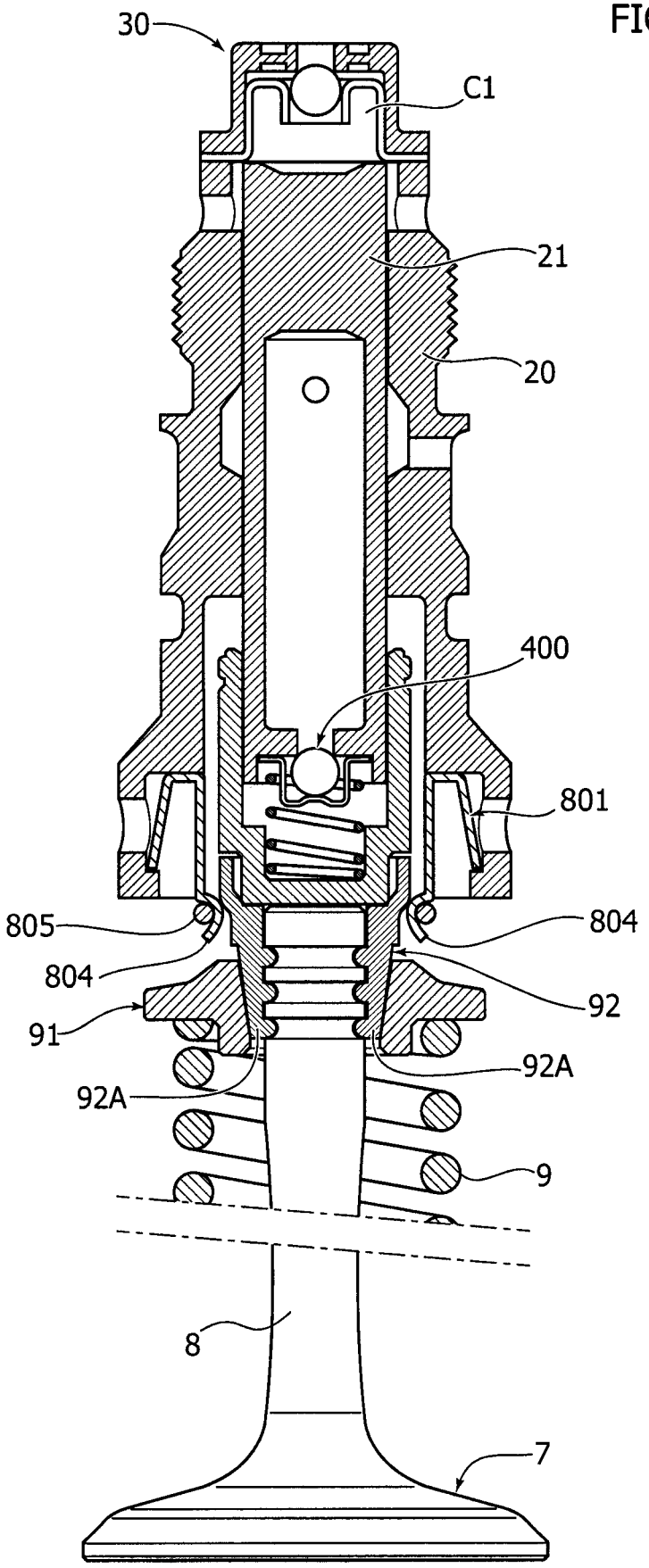
Figure 9:
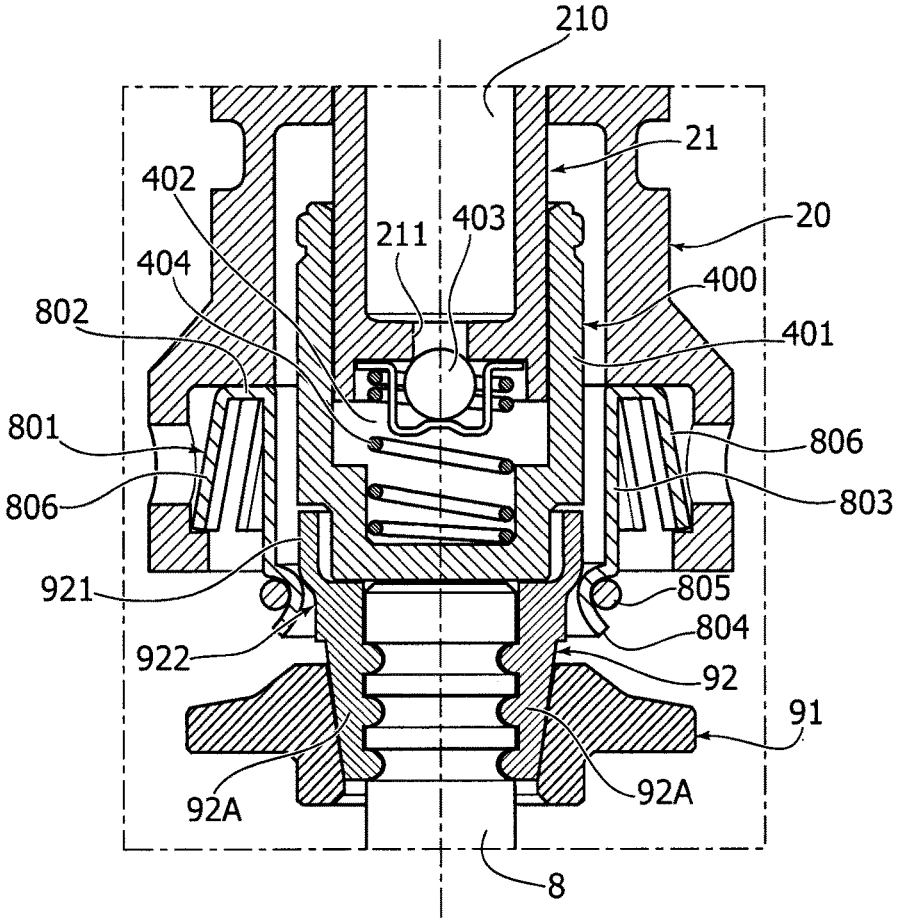
Figure 10:
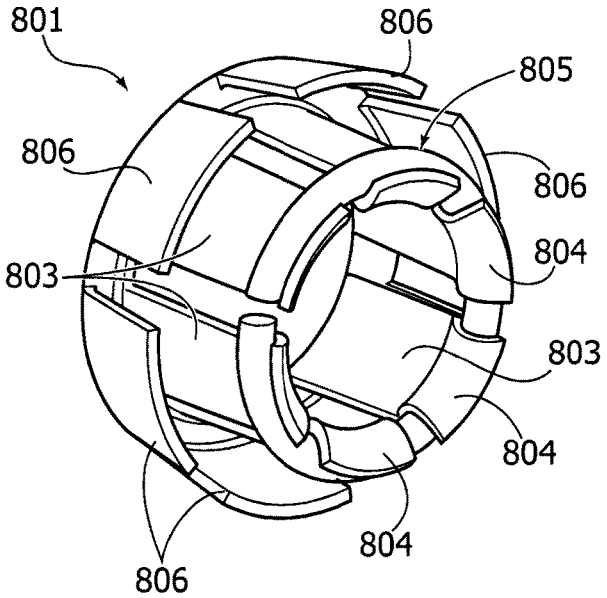
Figure 11:
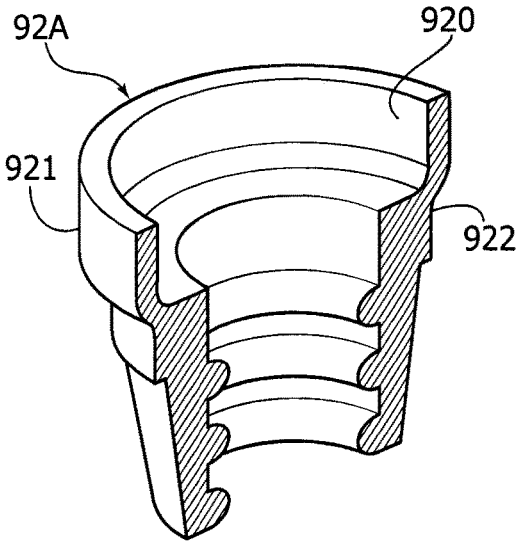
Figure 12:
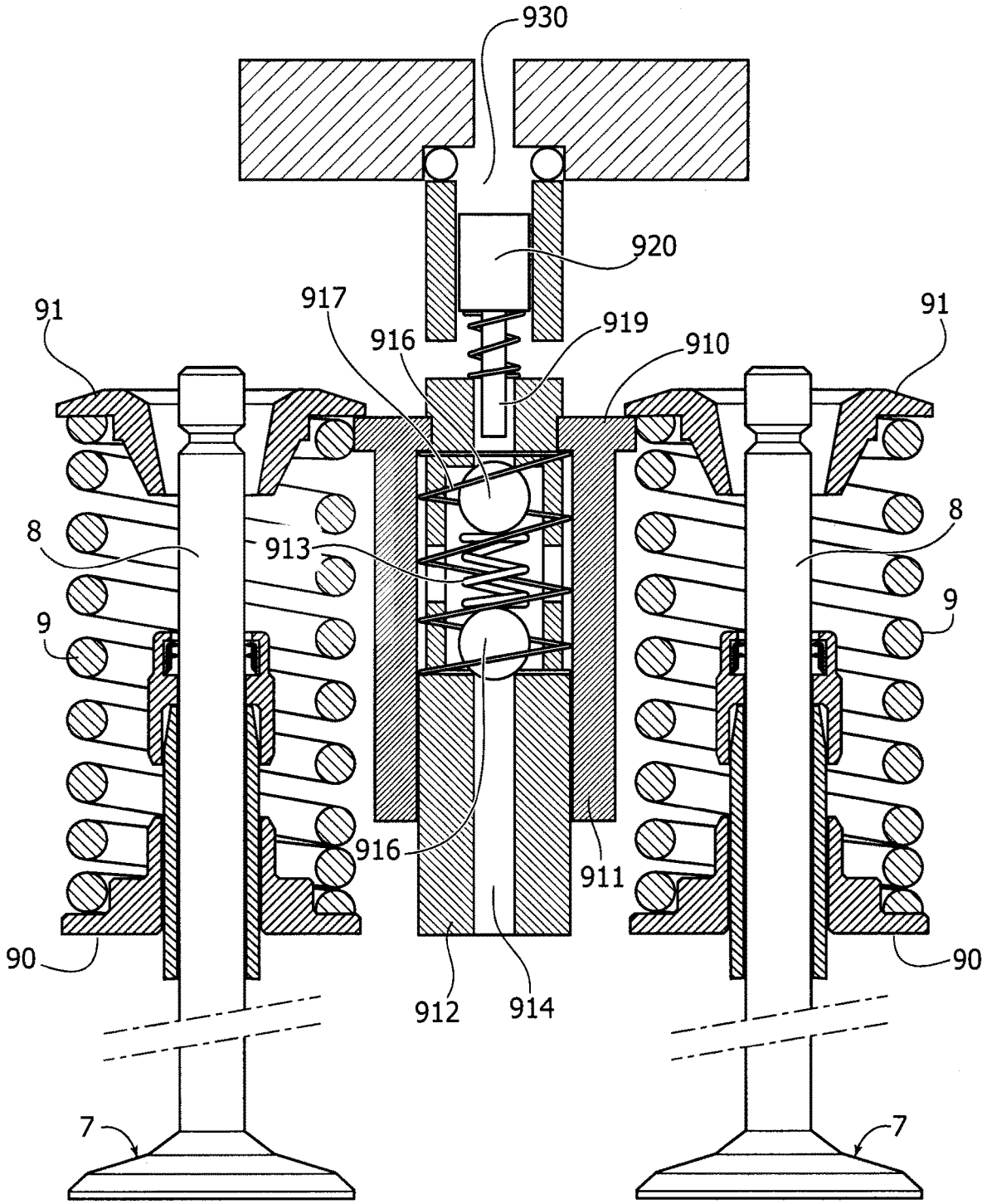
Figure 13:
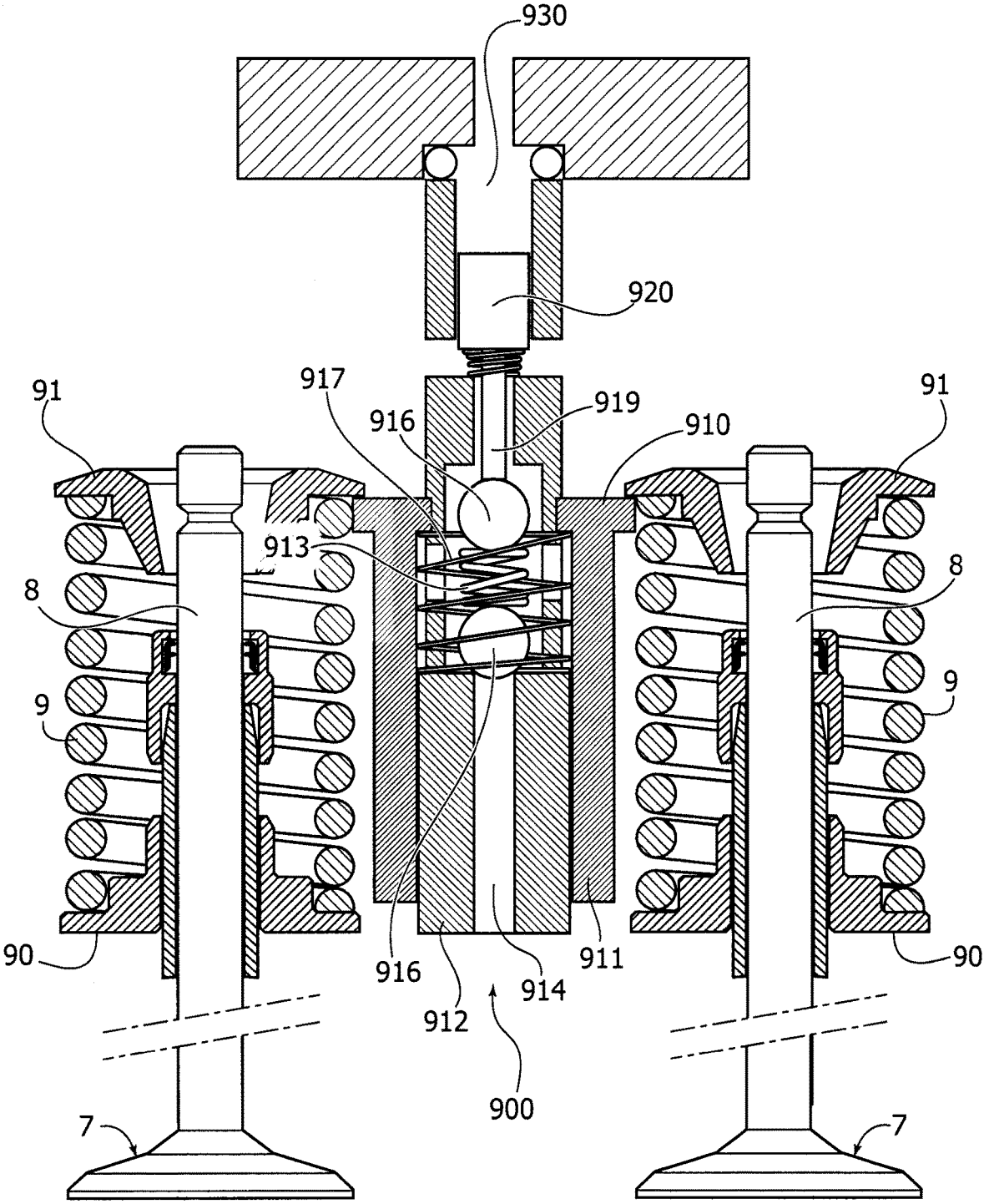
Figure 14:
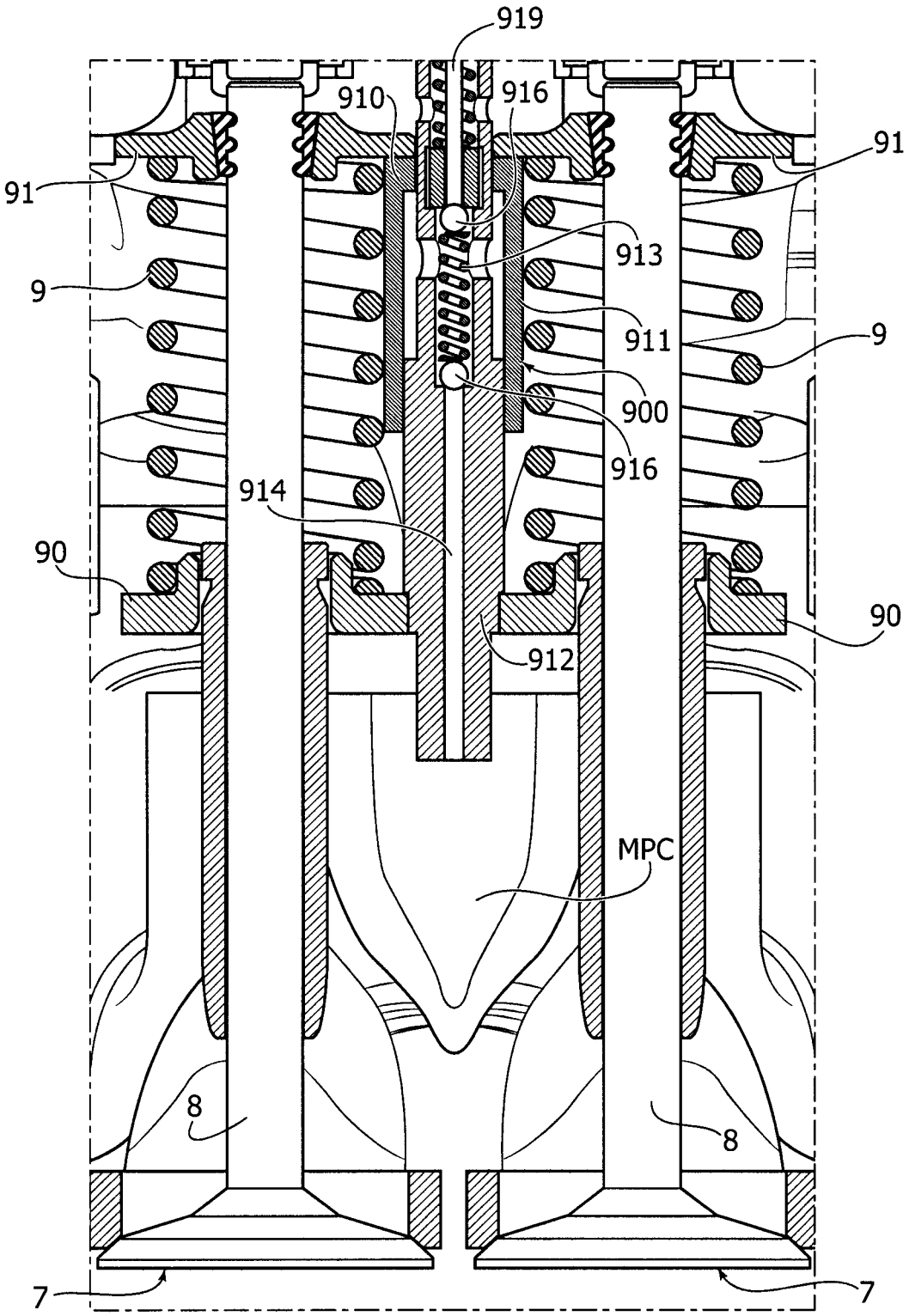

Further characteristics and advantages of the invention will become apparent from the description that follows with reference to the attached drawings, provided purely by way of non-limiting example, wherein:

FIG. 1 is a cross-sectional view of a cylinder head of an internal combustion engine provided with a variable actuating system for intake valves, according to the prior art, FIG. 2 is a diagram of a variable actuating system of the valves of an internal combustion engine, according to the prior art, FIG. 3 is an additional diagram of the system of FIG. 2, FIG. 3A is a perspective view of an embodiment example of the system according to the prior art, FIG. 4 is an additional schematic view of the system according to the prior art, FIG. 5 illustrates four different engine valve lift diagrams, corresponding to different valve modes obtainable with the system according to the prior art, FIG. 6 is a cross-sectional view on an enlarged scale of an actuating device for an engine valve according to the known solution illustrated in FIG. 3A, but modified according to the disclosures of the present invention, FIG. 7 is a diagram illustrating the operating principle of the device according to the invention, FIG. 8 is a cross-sectional view corresponding to that of FIG. 6, which illustrates a second embodiment of the device according to the invention, FIG. 9 is view on an enlarged scale of a detail of FIG. 8, FIGS. 10 and 11 are perspective views of two elements forming part of the device illustrated in FIGS. 8 and 9, FIGS. 12 and 13 are schematic views illustrating a third embodiment of the device according to the invention, in two different operative conditions, and FIG. 14 illustrates a constructive application of the embodiment of FIGS. 12 and 13.

FIG. 1 of the attached drawings shows a cross-sectional view of a cylinder head of an internal combustion engine according to the art described in document EP 0 803 642 B1. The cylinder head illustrated in FIG. 1 and indicated therein with reference numeral 1 is applied to an inline four-cylinder engine, being understood that the variable actuating system illustrated therein is of general application. The head 1 comprises, for each cylinder, a cavity 2 formed in the base surface 3 of the head and defining the combustion chamber. In the cavity 2 there are two intake ducts 4, 5 (duct 5 is illustrated with a dashed line) and two exhaust ducts 6 (only one of which is visible in the drawing). Communication of the two intake ducts 4, 5 with the combustion chamber 2 is controlled by two traditional mushroom-type intake valves 7 (only one of which is visible in the Figure), each comprising a stem 8 slidably mounted in the body of the head 1.

Each valve 7 is recalled towards the closed position by springs 9 interposed between an inner surface of the head 1 and an end spring plate 10 of the valve. Communication of the two exhaust ducts 6 with the combustion chamber is controlled by two valves 70 (one of which is visible in the Figure), of a traditional type, which also have associated return springs towards the closed position.

The opening of each intake valve 7 is controlled, as described below, by a camshaft 11 rotatably mounted about an axis 12 within the head supports 1 and comprising a plurality of cams 14 for actuating the intake valves 7 of the internal combustion engine.

Each cam 14 that controls an intake valve 7 cooperates with the plate 15 of a tappet 16 slidably mounted along an axis 17 which, in the case of the example illustrated in the aforementioned document, is substantially directed at 90° with respect to the axis of the valve 7. The plate 15 is recalled against the cam 14 by a spring associated therewith. The tappet 16 constitutes a pumping piston, or master piston, slidably mounted within a bushing 18 carried by a body 19 of a preassembled assembly 20 incorporating all the electrical and hydraulic devices associated with the actuation of the intake valves, according to that described in detail below. A separate assembly 20 can be provided for each cylinder of the engine.

The master piston 16 is able to transmit a thrust to the stem 8 of the valve 7, in order to cause the valve to open against the action of the elastic means 9, by pressurized fluid (preferably oil coming from the lubrication circuit of the engine) present in a volume of pressurized fluid C to which the master piston 16 faces, and by means of a slave piston 21 slidably mounted within a cylindrical body formed by a bushing 22, which is also carried by the body 19 of the preassembled assembly 20.

Still with reference to FIG. 1, the volume of pressurized fluid C associated with each intake valve 7 can be made to communicate with a lower pressure environment, constituted by an exhaust channel 23, through a solenoid valve 24. The channel 23 is configured to receive oil from the lubrication circuit of the engine fed by the pump of the lubrication circuit, by means of a duct having one or more air purge siphons and a non-return valve (see, for example, EP-A-1 243 761 and EP-A-1 555 398 by the Applicant).

The solenoid valve 24 can be of any known type suitable for the function illustrated herein, and is controlled by electronic control means 25, according to signals S indicative of operating parameters of the engine and/or of the variable actuating system of the engine valves, such as the accelerator position and engine speed, or the oil temperature or viscosity in the variable actuating system of the valves.

When the solenoid of the solenoid valve 24 is energized, the solenoid valve is closed, so as to keep the volume of fluid C under pressure, and to enable the actuation of each intake valve 7 by the respective cam 14, by means of the master piston 16, the slave piston 21 and the volume of oil contained therein.

When the solenoid of the solenoid valve 24 is de-energized, the solenoid valve opens, so that the volume C enters into communication with the channel 23, and the pressurized fluid present in the volume C flows into that channel. Consequently, decoupling of the cam 14 and the master piston 16 from the intake valve 7 is obtained, which then returns quickly to its closed position under the action of the return springs 9.

By controlling the communication between the volume C and the exhaust channel 23, it is therefore possible to vary the opening moment and/or the closing moment, and the opening stroke of each intake valve 7.

The exhaust channels 23 of the various solenoid valves 24 all lead into the same longitudinal channel 26 communicating with pressure accumulators 270, one of which is visible in FIG. 1. Each accumulator is substantially formed by a cylindrical body within which a piston is slidably mounted, defining a chamber of the accumulator communicating with the low pressure environment defined by the exhaust channels 23, 26. A helical spring inside the accumulator recalls the piston of the accumulator towards a position in which the reception volume of the fluid inside the accumulator is minimal. If the solenoid valve 24 is opened at a time in which the master piston 16 is in a compression state of the fluid present in volume C, part of the pressurized fluid present in volume C flows to the accumulator 270.

The master piston 16 with the associated bushing 18, the slave piston 21 with the associated bushing 22, the solenoid valve 24 and the channels 23, 26 are carried or formed in the aforesaid body 19 of the preassembled assembly 20, for the sake of speed and ease of assembly of the engine.

In the illustrated example, the exhaust valves 70 associated with each cylinder are traditionally controlled by a respective camshaft 28 through respective tappets 29, although in principle, the application of the variable actuating system to the exhaust valves is not excluded. This also applies to the present invention.

Still with reference to FIG. 1, the variable volume chamber defined within the bushing 22 and facing the sunken piston 21 (shown in FIG. 1 in its minimum volume condition, with the slave piston 21 in its upper end-stroke position) communicates with the volume of pressurized fluid C by means of an opening 30 formed in an end wall of the bushing 22. This opening 30 is engaged by an end nose 31 of the piston 21 in order to implement the hydraulic braking of the movement of the valve 7 during closing, when the valve is next to the closed position, as the oil present in the variable volume chamber is forced to flow into the volume of pressurized fluid C, by passing through the clearance existing between the end nose 31 and the wall of the opening 30 engaged therein. In addition to the communication formed by the opening 30, the chamber of pressurized fluid C and the variable volume chamber of the slave piston 21 communicate with each other by means of internal passages formed in the body of the slave piston 21, and controlled by a non-return valve 32 that only allows the flow of fluid from the pressurized volume C to the variable volume chamber of the slave piston 21. Various alternative embodiments of the hydraulic braking device of the slave piston 21 have been proposed, in the past, by the same Applicant (see, for example, EP-A-1 091 097 and EP-A-1 344 900). The object of the hydraulic braking device is to avoid a strong impact (and consequent noise) of the valve 7 against its seat when the valve 7 returns rapidly to the closed position as a result of an early opening of the solenoid valve 24.

During normal operation of the known engine illustrated in FIG. 1, when the solenoid valve 24 excludes the communication of the volume of pressurized fluid C with the exhaust channel 23, the oil present in the volume C transmits the movement of the master piston 16, imparted from the cam 14, to the slave piston 21, which controls the opening of the valve 7. In the reverse closure movement of the engine valve, as already said, during the final step, the nose 31 enters into the opening 30, causing hydraulic braking of the engine valve, so as to prevent the valve body bumping against its seat, for example, after opening of the solenoid valve 24, which causes the immediate return of the valve 7 to the closed position.

In the described system, when the solenoid valve 24 is activated, the valve of the engine follows the movement of the cam (full lift). An early closure of the engine valve can be obtained by opening the solenoid valve 24, so as to empty the volume of pressurized fluid C and to obtain closure of the valve 7 under the action of the respective return springs 9. Likewise, a delayed opening of the valve 7 can be obtained by delaying the closing of the solenoid valve 24, while the combination of a delayed opening with an early closing of the valve can be obtained by controlling the closing and opening of the solenoid valve during the thrust of the relative cam. According to an alternative strategy, in accordance with the disclosures of EP 1 726 790 A1 by the same Applicant, each intake valve can be controlled in a "multi-lift" mode, that is, according to two or more repeated opening and closing "sub-cycles". In each sub-cycle, the intake valve opens and then closes completely. The electronic control unit is, therefore, able to obtain a change in the time of opening and/or the time of closing and/or the lift of the intake valve, as a function of one or more operative parameters of the engine. This allows maximum efficiency of the engine to be obtained, and the lowest fuel consumption, in all operating conditions.

FIG. 2 of the attached drawings corresponds to FIG. 6 of the document EP 1 674 673 by the same Applicant, and shows the diagram of the actuating system of the two intake valves associated with each cylinder, in a conventional "Multiair" system. This Figure shows two intake valves 7 associated with the same cylinder of an internal combustion engine, which are controlled by a single master piston 16, in turn controlled by a single cam of the camshaft of the engine (not illustrated) acting against a plate 15. The Figure does not illustrate the return springs 9 (see FIG. 1) that are associated with the valves 7, and which tend to return these valves back into their respective closed positions. As can be seen, in the conventional system of FIG. 2, a single master piston 16 controls the two intake valves 7, by means of a single volume of pressurized fluid C, which communicates with the discharge under the control of a single solenoid valve 24. The volume of pressurized fluid C is in hydraulic communication with both the variable volume chambers C1, C2 facing two slave pistons 21 for controlling the intake valves 7 of the same cylinder.

The system of FIG. 2 is able to operate efficiently and reliably, especially when the volumes of the hydraulic chambers are relatively small. This possibility is offered by the use of hydraulic tappets 400 outside the bushings 22, according to that already illustrated in detail, for example, in the document EP 1 674 673 B1 by the Applicant. In this way, the bushings 22 can have an inner diameter that can be selected as small as is required.

FIG. 3 of the attached drawings is a schematic representation of the system illustrated in FIG. 2, in which it is evident that both the intake valves 7 associated with each engine cylinder have the hydraulic chambers of the two slave pistons 21 permanently in communication with the pressurized volume C, which, in turn can be isolated or connected with respect to the discharge channel 23, by means of the single solenoid valve 24.

FIG. 3A of the attached drawings shows a perspective view of the main components of a known embodiment of the Applicant's MultiAir system (the components associated with a cylinder of the engine are illustrated), corresponding to the general scheme of FIGS. 2, 3 of the attached drawings. In FIG. 3A, the parts common to those of FIGS. 1-3 are indicated by the same reference numbers.

In the case of the embodiment of FIG. 3A, the master piston 16 is controlled by the respective cam 14 by means of a rocker arm 140 having an intermediate portion carrying a freely rotatable roller 141 that engages with the cam 14. The rocker arm 140 has one end rotatably supported by a support member 142 mounted in the assembled assembly 20. The opposite end of the rocker 140 engages with the plate 15 of the master piston 16. FIG. 3A does not show the spring that draws the plate 15 against the cam 14. FIG. 3A shows the communications of the high pressure volume C with the solenoid valve 24, and of the solenoid valve 24 with the chambers associated with the two slave pistons 21.

FIG. 4 of the attached drawings is a further simplified schematic view of a variable actuating system of an engine valve of the type to which the present invention relates. In this Figure, the parts corresponding to those of FIGS. 1-3 and 3A are indicated by the same reference numbers.

FIG. 4 shows an engine valve 7 drawn towards a closed condition, against a valve seat 7*a*, by a spring 9. The valve 7 can be actuated by the slave piston 21 under the thrust of the master piston 16, by means of the interposition of the fluid in the pressurized volume C. The master piston 16 is rigidly connected to a plate 15, which is in sliding contact with the cam 14, and which is drawn against the cam 14 by a spring 15*a*. The valve 7 can be controlled by the cam 14 when the solenoid valve 24 keeps the communication closed between the volume of pressurized fluid C and the lower pressure volume 23, which is in communication with the fluid accumulator 270.

FIG. 4 also shows the supply line 230, which is configured to supply the fluid, specifically engine lubrication oil, coming from the engine lubrication circuit, by means of a supply pump (not shown in the drawing). In the supply line 230, a non-return valve 231 is interposed, which only allows flow in the direction of the channel 23 communicating with the fluid accumulator 270. In the line 230 one or more siphon devices (not shown) are also interposed, for purging the air, as illustrated, for example, in documents EP-A-1 243 761 and EP-A-1 555 398 by the same Applicant.

Still with reference to the characteristics of the known system already implemented by the Applicant, which are also usable within the scope of the present invention, it should be noted that a hydraulic clearance compensation device 400 ("lash adjuster") can be interposed between the slave piston 21 and the stem of the engine valve 7. This solution is, for example, described in the document EP-A-1 635 045 by the same Applicant.

In the aforesaid known systems, the electronic control unit 25 is programmed to implement different actuating modes of an engine valve (in the example illustrated in FIGS. 1-3 and 3A, an engine intake valve), according to the operating conditions of the engine.

FIG. 5 of the attached drawings schematically shows four different valve modes with which an engine valve can be actuated. In this Figure, the different valve modes are illustrated by diagrams showing the lift of the engine valve as a function of the engine angle. The valve mode "FL" ("full lift") is that in which the control valve 24 keeps the communication passage closed between the volume of pressurized fluid C and the lower pressure environment 23, for the entire duration of the active cycle of the cam 14 in which the part of the cam profile that exceeds the circular base profile is in contact with the plate 15 (see FIG. 4), in order to keep the valve 7 open. In the FL mode, the lift profile of the valve 7 therefore corresponds to the lift profile of the cam 14, less than a multiplying factor dependent on the ratio between the diameter of the master piston 16 and the diameter of the slave piston 21; furthermore, by simplification, the volume of fluid potentially drawn through the dynamic seals of the different couplings is not considered.

The valve mode "EVC" ("early valve closing") envisages that the solenoid valve 24 keeps the communication passage closed between the volume of pressurized fluid C and the lower pressure environment 23 at the beginning of the lift cycle of the cam 14, so that a first part of the lift profile of the engine valve corresponds to the first part of the lift profile of the cam 14. However, in this mode, the valve 24 opens the aforesaid communication before the lift cycle of the cam 14 is terminated. When the communication opens, pressurized fluid flows from the chamber C to the lower pressure environment 23 and the valve 7 rapidly closes, under the action of the return spring 9, even if the cam 14 is still in a position in which it would tend to keep the valve open. Therefore, the lift profile of the valve 7, in the EVC mode, follows the line indicated with a continuous line, in place of the dashed line profile, corresponding to the profile of the cam. With this operation mode, the engine valve 7 then reaches the closed condition in advance with respect to the closing time in the FL mode.

Again, with reference to FIG. 5, the valve mode "LVO" ("late valve opening") envisages that, at the beginning of the lift cycle of the cam 14, the control valve 24 keeps the communication open between the volume C and the lower pressure environment 23. Therefore, when the cam 14 would tend to open the valve 7, this valve remains closed, since the fluid displaced by the master piston 16 can discharge into the lower pressure chamber 23 and into the fluid accumulator 270. In the LVO mode, the control valve 24 closes the communication passage between volume C and the lower pressure environment 23 at a time after the start of the lift cycle of the cam 14. Starting from this time, the valve 7 can be controlled by the cam 14. However, in this case, the valve 7 has a smaller lift profile than that of the conventional cycle, since it starts to open when the master piston 16 has already completed the first part of its stroke under the thrust of the cam 14. Therefore, in the LVO mode, the valve 7 returns to the closed position at an earlier time with respect to the conventional cycle corresponding to the cam profile (represented with a dashed line in the LVO diagram).

An additional valve mode "ML" ("multi-lift") enables the control valve 24 to close and open the aforesaid communication several times within the same lift cycle of the cam 14, in such a way that the valve 7 opens and closes completely two or more times within the same lifting cycle of the cam. Also in this mode, as in the LVO mode, it can be verified that the valve 7 closes before the closing of the conventional cycle corresponding to the cam profile, even if the control valve 24 keeps the communication closed between the volume C and the lower pressure environment 23.

FIG. 6 illustrates an embodiment example of a device for actuating an engine valve forming part of a variable actuating system of the type described above and produced according to the disclosures of the present invention.

In FIG. 6, the parts common to those of FIGS. 1-5 are indicated by the same reference numbers. Therefore, also in FIG. 6 the reference number 21 indicates a slave piston that is slidably guided in a guide bushing 20 mounted inside the cylinder head of an internal combustion engine, and which drives an engine valve 7 by means of a hydraulic tappet 400. The lower end of the piston 21 is in operative contact with the upper end of the stem 8 of the valve 7, with the interposition of the tappet 400. The valve 7 is drawn towards its closed position by a helical spring 8, which has its lower end in contact with a support disc 90 secured to the cylinder head structure and its upper end in contact with a disc 91 rigidly connected to the upper end of the stem 8 of the valve 7, by means of the interposition of a conical bushing body 92 defined, according to the conventional art, by two semicones 92A, which are in contact with each other along a plane containing the axis of the stem 8 (one of which is illustrated in a perspective view in FIG. 11, with reference to the embodiment of FIG. 8).

The upper end of the slave piston 21 faces a variable volume chamber C1, which, in turn is intended to communicate with the volume of pressurized fluid C. At the top of the guide bushing 20, a hydraulic braking device 30 is provided, which reduces the communication passage between the chamber C1 and the chamber C in the final closing step of the engine valve, in order to brake the movement of the engine valve, so as to avoid an impact of the engine valve against its seat 7A upon reaching the closed position.

All the characteristics described above with reference to FIG. 6 are common to the solution of the prior art. For this reason, the constructional details relating to the elements mentioned above are not further described herein, also because they could be made in any other known manner.

In the embodiment of FIG. 6, the main difference between the invention and the known solution resides in that, in this case, a solenoid S is provided, having an annular body mounted coaxially to the guide bushing 20 and to the tappet 400, for each engine valve, within a seat 600 formed in the cylinder head body and in a position facing the valve 7. The electrical power supply of the solenoid S is controlled by an electronic control unit E, which, for example, may coincide with the electronic control unit 25 of the variable actuation system of the valves. The solenoid S cooperates with a plate made of ferromagnetic material, consisting of a flat disc 601 rigidly connected to the annular element 91 associated with the stem 8 of the valve 7. Therefore, the plate 601 moves together with the valve 7.

According to the invention, the electronic unit E is configured to supply current to the solenoid S during each rotation cycle of the actuating cam 14 (FIG. 4) in the steps in which the engine valve must remain closed, so as to create an auxiliary force $F_{aux}$, which attracts the plate 601 against the solenoid S, and which is therefore added to the force $F_s$ generated by the spring 9.

FIG. 7 shows the diagram, VL of the lift of the valve 7 as the engine angle changes (the rotation of the cam is linked to the rotation of the engine shaft according to a 2:1 ratio), and also shows the current signal IS indicative of the power supply to the solenoid S, when the engine angle changes. The signal IS can assume a value 1, corresponding to the supply of current to the solenoid S, or a value 0, corresponding to the absence of current supplied to the solenoid S. As is evident from FIG. 7, in the case of the invention, the electronic unit E is programmed to not supply current to the solenoid S during the part of the rotation cycle of the cam 14 that causes opening of the engine valve, and to instead feed current to the solenoid S in the remaining part of the rotation cycle of the cam.

Incidentally, in the example of FIG. 7, the profile of the valve lift diagram is a so-called "boot profile", which is determined by a corresponding shape of the actuating cam 14. This solution corresponds to a known solution proposed by the same Applicant.

However, application of the invention is general. In particular, the invention is applicable both to variable actuation systems of different types of valves, for example, with a more traditional cam profile, without a boot profile, as well as to conventional systems that do not provide a variable actuation of the engine valves.

With reference again to FIG. 7, the control of the solenoid S according to the above described modality allows generation of a total force F, tending to keep the engine valve closed, which is greater during the steps in which the engine valve must remain closed ($F=F_s+F_{AUX}$), while this force is reduced during the step in which the engine valve must be actuated ($F=F_s$). In this way, on one hand, it is ensured that the engine valve remains closed in the steps in which it must be in the closed position, for all operating conditions of the engine and whatever the driving condition of the vehicle in which the engine is used. At the same time, in the active actuation phase of the engine valve, the force that must be overcome to obtain opening of the engine valve is lower.

In the prior art resolutions, where the force tending to keep the engine valve closed is generated solely by the spring 9, this spring must be designed and arranged to generate a relatively high return force, in order to ensure that the engine valve remains closed in the conditions in which it must be closed. In the case of the present invention, instead, during the phases in which the engine valve must remain closed, the necessary force is obtained thanks to the auxiliary device (whatever its embodiment). This makes it possible to design and arrange the spring 9 with a significantly lower rigidity and/or load. Consequently, in the phase in which the slave piston 21 must cause the engine valve to open, the force that it has to overcome is considerably reduced compared to the prior art solutions described above. Consequently, the pressure level that must be maintained in the high pressure volume C can also be lower than that which is necessary in the known solutions.

The main advantage deriving from the aforesaid device lies in the fact that the system is able to actuate the engine valve easily and immediately, without the risk of a loss of movement in the transmission of motion from the cam to the valve; moreover, as the pressure level is lower, this results in a reduction in the compression work of the aforesaid oil, with obvious benefits on the organic performance of the engine Naturally, in the case of application to a variable actuation system of the valves, to which the example of FIG. 6 refers, the electronic control unit E can be configured to extend the period in which the signal IS has a value 1, that is, to supply current to the solenoid S, at the phases in which the actuating chamber 14 is also decoupled from the cam, since the solenoid valve 24 (FIGS. 1-4) is open.

FIG. 8 shows a mechanical variant of the solution of FIG. 6, corresponding to a second embodiment of the invention. In FIG. 8, the parts common with FIG. 6 are indicated with the same references. In this case, the solenoid S and the plate 601 are not provided. In place of these elements, an auxiliary elastic element 801 (visible on an enlarged scale in FIG. 9 and in a perspective view in FIG. 10) is arranged within an end 20A of the guide bushing 20. The auxiliary elastic element 801 is in the form of a cylindrical element of sheet metal. The element 801 includes an upper ring 802 arranged in a plane orthogonal to the axis of the guide bushing 20. From the radially inner edge of the ring 802, a crown of elastically deformable wings 803 extends, projecting in an overhanging manner, and ending with curved ends 804. The curved ends 804 of the wings 803 act as seats for a split elastic ring 805, which tends to impede a widening in the radial direction towards the outside of the ends 804. From the radially outer edge of the ring 802, further external wings 806 protrude, for anchoring the auxiliary elastic element 801 within a seat 807 formed in the lower end (with reference to the Figures) of the guide bushing 20. As can be seen more clearly in FIG. 9, the ends 804 of the wings 803 are in contact with the outer surface of the bushing 92 defined by the two semi-cones 92A (one of which is visible in FIG. 11). With respect to the conventional conformation, the two cones 92A are modified by integrating an upper end portion 920 in them, which extends beyond the upper end of the valve stem 8, and which receives therein a reduced diameter end of an element 401 forming part of the hydraulic tappet 400.

According to the conventional technique, the element 401 is slidably mounted on the lower end of the piston 21 and defines within it the hydraulic chamber 402 of the tappet 400. The chamber 400 contains a non-return valve that controls the communication between the chamber 402 and a chamber 210 formed within the slave piston 21. This non-return valve comprises a valve element 403 pushed by a spring 404 towards a position in which it closes a communication hole 211 between the chamber 402 and the chamber 210. All the aforesaid elements of the hydrated tappet 400 are known per se and are only illustrated here to allow a complete understanding of the device illustrated in FIG. 9. However, it would also be possible to adapt the solution described here to a piston 21 without a hydraulic tappet, and that is placed directly in contact with the end of the valve stem 8.

In any case, what is important is that the end portion 920 of the bushing 92, defined by the two semi-cones 92A, has a cylindrical outer surface with a flush arrangement and placed on the extension of the outer surface of the element 401 with which it is in contact. Furthermore, this outer cylindrical surface of the end portion 920 is joined to the lower portion of the outer surface of the bushing 92, defined by the two semi-cones, by means of a tapered surface 922, which acts as a cam, configured to cooperate with the ends 804 of the elastic wings. 803.

The operation of the embodiment illustrated in FIGS. 8-11 is as follows.

Starting from the closed condition of the valve 7 (illustrated in FIGS. 8 and 9) an opening movement of the valve causes a lowering (with reference to the Figures) of the bushing 92 defined by the two semi-cones 92A with respect to the ends 804 of the elastic wings 803. The engagement of the inclined surface 922 against the ends 804 determines, in the first opening phase of the engine valve, an enlargement of the wings 803, which consequently generate an elastic reaction force against the inclined surface 922, tending to draw the valve into the closed position. Therefore, in this embodiment, when the engine valve is closed, the force tending to keep the valve in this closed position is determined by the sum of the elastic reaction of the spring 9 and of the elastic reaction of the wings 803 of the auxiliary elastic element 800.

As soon as the engine valve 7 has moved away from its closed position by a distance sufficient to bring the ends 804 of the elastic wings 803 into contact with the cylindrical portion 921 of the outer surface of the bushing 92 defined by the two semi-cone 92A, further movement of the engine valve takes place with the ends 804 that slide on the aforesaid cylindrical surface 921 and then on the cylindrical surface of the element 401, remaining in their enlarged deformed condition, but without contributing to the force that tends to return the valve back into the closed position. In this condition, if friction is ignored between the ends 804 and the cylindrical surface that slides between them, the force opposing the opening of the engine valve is substantially only that generated by the spring 9.

Therefore, the solution of FIGS. 8-11 generates a difference in the return force of the engine valve between the phases in which the engine valve is in a closed or substantially closed position, and the phases in which the engine valve is spaced apart from this closed position. Again, even in this case, there is the advantage that the force that must be overcome by the system to open the engine valve can be significantly reduced compared to that occurring in known solutions, while at the same time, guaranteeing that the engine valve remains closed in all the phases in which it must be closed.

FIGS. 12 and 13 refer to a third embodiment of the present invention. These Figures show the stems 8 of two intake valves associated with the same cylinder of the engine, and the springs 9 that tend to draw the valves 7 towards the closed position. Also in this case, each spring 9 has its lower end in contact with a disc 90 secured to the cylinder head structure of the engine and its upper end resting against a support disc 91 secured to the upper end of the stem 8.

In the case of the embodiment illustrated in FIGS. 12 and 13, the two support elements 91 cooperate with the head 910 of a cylindrical bushing 911 slidably mounted above a cylindrical stem 912 having an axis 913 parallel to the axes 8A of the two stems 8. The bushing 911 and the stem 912 constitute the two mutually sliding elements of a hydraulic cylinder 900.

Within the cylindrical stem 912, a chamber 913 is defined, which is capable of communicating with the low pressure fluid environment through an axial duct 914, and with an axial duct 915, formed in the stem 912 on opposite sides with respect to the chamber 913. Communication of the chamber 913 with the ducts 914, 915 is controlled by two non-return valves, comprising two spheres 916 between which a spring 917 is interposed. A spring 918 inside the bushing 911 is interposed axially between the head 910 of the bushing 911 and a striking surface formed on the cylindrical stem 912. The spring 918 tends to maintain the hydraulic cylinder 900 defined by the bushing 911 and the stem 912 in a configuration of maximum extension, corresponding to the maximum extension of the spring 918. Communication of the chamber 913 with the low pressure environment can be established by a pin actuator 919 carried by a small piston 920, which is slidably mounted within a cylindrical body 921, rigidly connected to the cylinder head structure. The small piston 920 faces a chamber 930 that is in communication with the high pressure environment of the variable actuating system of the engine intake valves. Therefore, when the volume C (FIGS. 2 and 4) is pressurized by closing the solenoid valve 24, the pressure is also communicated to the small piston 920, which causes the opening of the communication of the chamber 913 with the discharge environment (FIG. 13), against the action of a spring. In this condition, the bushing 911 and the cylindrical stem 912 can move axially relative to each other, causing compression of the spring 918, so that the engine valves 7 can be opened. On the contrary, when the volume C is not under pressure, i.e. in all the phases in which the actuating chamber 14 is not pushing the master piston, or in the phases in which the cam is decoupled from the engine valve, because the solenoid valve 24 is open, the chamber 913 is isolated, so that the cylinder 900 consisting of the two elements 911, 912 is an incompressible element that keeps the engine valve in the closed position. Therefore, once again, the advantage is obtained of ensuring, on the one hand, that the engine valve remains closed in all conditions in which it must be closed, and on the other hand, of consequently reducing the return force generated by the springs 9, with the advantages that have been discussed previously.

FIG. 14 illustrates a concrete embodiment of the solution shown in FIGS. 12 and 13. In this Figure, the parts corresponding to those of FIGS. 12 and 13 are indicated by the same reference numbers.

As is clear from the above description, the system according to the present invention is based on the principle of varying the force that tends to keep the engine valve (for example, an intake valve) in the closed position during each rotation cycle of the actuating cam, in such a way that this force is greater in the part of the rotation cycle of the cam corresponding to the closed position of the engine valve, and is reduced in the part of the rotation cycle of the cam that causes a movement of the engine valve.

In an embodiment of the invention, not illustrated and described, the auxiliary device is designed for inserting and disengaging a constraint, or rather an almost infinite force, upon axial translation of the valve: said constraint remains inserted during the angular interval during which the valve must remain closed.

In general, the invention is applicable to any hydraulic actuating system of an engine valve, both for the intake valves and for the engine exhaust valves. It has been shown that the application of the invention to a variable actuating system of an engine valve is particularly advantageous.

As indicated, the invention can also be applied to a mechanical actuating system, of the type in which a tappet controlled by the cam mechanically actuates the engine valve.

Of course, without prejudice to the principle of the invention, the details of construction and the embodiments may vary widely with respect to those described and illustrated purely by way of example, without departing from the scope of the present invention.

The invention claimed is:

1. A variable actuation system for actuating an engine valve of an internal combustion engine, comprising:

a movable master piston controlled, directly or indirectly, by an actuating cam of a camshaft of the internal combustion engine and connected, mechanically or hydraulically, to the engine valve, a slave piston, which actuates said engine valve and which is hydraulically controlled by said master piston, by a volume of pressurized fluid interposed between the master piston and the slave piston, at least one return spring biasing the engine valve to a closed position, an auxiliary device for applying an additional force to the engine valve, tending to maintain the engine valve in the closed position, said auxiliary device being configured or controlled in such a way that a total force tending to keep the engine valve in the closed position varies during each rotation cycle of the actuating cam of the camshaft, said total force being higher at least in a part of the rotation cycle of the actuating cam in which the engine valve must remain in the closed position, said part of the rotation cycle being when the cam cannot cause movement of the master piston, and in all conditions in which the variable actuating system excludes a coupling between the cam and engine valve by discharging the volume of pressurized fluid, and said force being reduced at least in another part of the rotation cycle of the actuating cam in which the engine valve is not in the closed position.

2. A system according to claim 1, wherein said auxiliary device comprises a solenoid carried by an engine structure and a ferromagnetic anchor associated with the engine valve and configured to cooperate with the solenoid to tend to keep the engine valve in its closed position when the solenoid is energized, said auxiliary device also comprising a control circuit of said solenoid configured to supply current to the solenoid, at least in one part of the rotation cycle of the cam in which the engine valve remains in the closed position and not to supply current to the solenoid at least in one part of the rotation cycle of the cam in which the engine valve is not in the closed position.

3. A system according to claim 1, wherein said auxiliary device comprises an auxiliary elastic element carried by a supporting structure that is stationary with respect to said engine valve during a movement of the engine valve and configured to cooperate with an engagement element associated with said engine valve in such a way that in a first step of opening the engine valve, a cam surface of said engagement element associated with the engine valve deforms said auxiliary elastic element, generating an additional force tending to close the engine valve, while in a second step of opening of the engine valve, said auxiliary elastic element is in sliding engagement against a cylindrical surface of said engagement element, so that said auxiliary elastic element remains in a deformed condition, but substantially no longer exerts any additional return force biasing the engine valve towards its closed position.

4. A system according to claim 1, further comprising:

the master piston controlled, directly or indirectly, by said cam of the camshaft of the internal combustion engine, the slave piston, which actuates said engine valve and which is hydraulically controlled by said master piston, by a volume of pressurized fluid interposed between the master piston and the slave piston.

5. A system according to claim 4, wherein the system is a variable actuating system of the engine valve, also including:

an electrically-actuated control valve, which controls the communication between said volume of pressurized fluid and an environment at a lower pressure connected to a fluid accumulator, in such a way that:

when the electrically-actuated control valve keeps said communication closed, the engine valve can be actuated by said cam, while when the electrically-actuated control valve keeps said communication open, fluid may discharge from the volume of pressurized fluid into the aforesaid lower pressure environment, so that the engine valve remains insensitive to a movement of said cam, an electronic control circuit to control said electrically-actuated control valve, said electronic control circuit being programmed to control said electrically-actuated valve in such a way as to actuate the engine valve according to one or more different valve modes, depending on the operating conditions of the engine.

6. A system according to claim 5, wherein said auxiliary device comprises an electrically-actuated member that controls the generation of an additional force tending to keep the engine valve in the closed position, and in that said electronic control circuit is configured to control said electrically-actuated member in such a way that the total force tending to keep the engine valve in the closed position is increased during each rotation cycle of the cam, at least in a phase in which the engine valve must remain in the closed position, while said total force is reduced in the phase in which the opening of the engine valve is actuated.

7. A system according to claim 1, wherein said movable member is a tappet connected to said engine valve.

8. A method for actuating an engine valve of an internal combustion engine, comprising:

arranging a master piston controlled, directly or indirectly, by a cam of a camshaft of the internal combustion engine, arranging a slave piston, which actuates said engine valve and which is hydraulically controlled by said master piston, by a volume of pressurized fluid interposed between the master piston and the slave piston, arranging a spring tending to keep said engine valve in a closed position, an auxiliary device generating an additional force tending to keep the engine valve in the closed position, and said auxiliary device controlling the total force that tends to keep the engine valve in the closed position such that the force is varied during each rotation cycle of the cam for actuating the engine valve and in all conditions in which a coupling between the cam and the engine valve is excluded by discharging the volume of pressurized fluid.

9. A method according to claim 8, wherein said total force is varied in such a way that it is higher at least in one part of the rotation cycle of the cam wherein the engine valve must remain in the closed position, and is reduced at least in one part of the rotation cycle of the cam wherein the engine valve is not in the closed position.

* * * * *